US005694665A

United States Patent [19]

Strickland et al.

[11] Patent Number: 5,694,665

[45] Date of Patent: Dec. 9, 1997

[54] ADJUSTABLE HINGE

[75] Inventors: Kenneth W. Strickland, South Windsor; Gregg C. Krehel, Newtown, both of Conn.

[73] Assignee: The Stanley Works, New Britain, Conn.

[21] Appl. No.: 616,814

[22] Filed: Mar. 15, 1996

[51] Int. Cl.[6] ..... E05D 7/04

[52] U.S. Cl. ..... 16/238; 16/243; 16/246; 16/237

[58] Field of Search ..... 16/237, 236, 238, 16/239, 240, 241, 243, 244, 245, 246

[56] References Cited

U.S. PATENT DOCUMENTS

| | | | |
|---|---|---|---|
| 928,760 | 7/1909 | Hunter . | |
| 1,314,732 | 9/1919 | Cochran et al. . | |
| 2,373,955 | 4/1945 | Fuller . | |
| 2,641,794 | 6/1953 | Raskin . | |
| 2,725,589 | 12/1955 | Papesh . | |
| 2,779,966 | 2/1957 | Torchia . | |
| 3,007,193 | 11/1961 | Hughes et al. . | |
| 3,596,307 | 8/1971 | Kolmetsky . | |
| 4,159,557 | 7/1979 | Pittasch et al. | 16/237 |
| 4,825,507 | 5/1989 | Killingstad | 16/241 |
| 4,837,893 | 6/1989 | Wilson | 16/240 |
| 5,058,236 | 10/1991 | Henson | 16/238 |
| 5,144,721 | 9/1992 | Schade | 16/237 |
| 5,339,493 | 8/1994 | MacIntyre | 16/238 |
| 5,375,296 | 12/1994 | Zaleskie | 16/237 |

FOREIGN PATENT DOCUMENTS

| | | | |
|---|---|---|---|
| 3732023 | 4/1989 | Germany | 16/238 |
| 3-39581 | 2/1991 | Japan | 16/243 |
| 3-187486 | 8/1991 | Japan | 16/237 |
| 5-71261 | 3/1993 | Japan | 16/240 |

*Primary Examiner*—Chuck Y. Mah
*Assistant Examiner*—Donald M. Gurley
*Attorney, Agent, or Firm*—Pepe & Hazard

[57] ABSTRACT

An adjustable hinge for pivotally mounting a door on a frame has a first leaf mounted and an adjustable mounting assembly to be mounted on the frame or the door. The mounting assembly includes (i) a bracket, (ii) a vertically extending threaded shaft, (iii) an internally threaded pinion gear, and (iv) a rotatable screw. The threaded shaft is fixed on the bracket and threadably engaged with the pinion gear. The rotatable screw has a threaded outer surface portion engaged with the pinion gear for rotating the pinion gear relative to the shaft so as to axially move the gear relative to the shaft. A second leaf is pivotally mounted on the mounting assembly and has one end pivotally engaged with the first leaf. A horizontally extending adjusting screw has a shank threadably engaged in the second leaf, and the end of the shank abuts the bracket so that the rotation of the adjusting screw pivots the second leaf inwardly and outwardly relative to the bracket. The pinion gear abuts a surface on the second leaf so that the rotation of the pinion gear by the rotatable means moves the second leaf vertically relative to the bracket.

14 Claims, 4 Drawing Sheets

ADJUSTABLE HINGE

BACKGROUND OF THE INVENTION

The present invention relates to adjustable hinges for mounting a door on a frame, and, more particularly, to an adjustable hinge which enables the position of the door to be adjusted relative to the frame in both vertical and horizontal directions.

Adjustable hinges are widely employed to adjust doors relative to frames so that the doors will be level and fit well within the frame. The adjustable hinges which are presently available are often more complex, expensive and more difficult to install than conventional non-adjustable hinges. Moreover, adjustable hinges are often time-consuming and sometimes difficult to adjust because of the inaccessibility of the adjustment mechanisms and the requirement of additional support for the door during adjustment.

It is an object of the present invention to provide a novel adjustable hinge for mounting a door on a frame which enables facile vertical and horizontal adjustment of the door relative to the frame.

It is also an object to provide such an adjustable hinge which is readily installed on the door and its frame.

Another object is to provide such an adjustable hinge which enables adjustment without requiring additional support for the door.

Yet another object is to provide such an adjustable hinge which is rugged and long-lived, and which may be fabricated relatively easily and economically.

SUMMARY OF THE INVENTION

It has now been found that the foregoing and related object may be readily attained in an adjustable hinge for pivotally mounting a door on a frame, comprising a first leaf mounted on the frame or door and an adjustable mounting assembly mounted on the other member. The mounting assembly includes (i) a bracket, (ii) a vertically extending threaded shaft, (iii) a pinion gear, and (iv) a rotatable means. The threaded shaft is fixed on the bracket and threadably engaged with the internally threaded pinion gear. The rotatable screw has a threaded outer surface portion engaged with the pinion gear for rotating the pinion gear relative to the shaft so as to move the gear axially of the shaft.

A second leaf is pivotally mounted on the mounting assembly and has one end pivotally engaged with the first leaf. A horizontally extending adjusting screw has a shank threadably engaged in the second leaf intermediate the ends thereof, and the end of the shank abuts the bracket. The pinion gear abuts a surface on the second leaf so that the rotation of the pinion gear by the rotatable means moves the second leaf vertically relative to the bracket, and the rotation of the adjusting screw pivots the second leaf inwardly and outwardly relative to the bracket.

Generally, the first leaf is mounted on the frame, and the mounting assembly is mounted on the door. Preferably, the threaded surface portion of the rotatable means provides a worm gear to rotate the pinion gear.

Conveniently, the mounting assembly has a horizontally extending flange with a vertically extending slot and the end of the second leaf opposite the one end has an outwardly extending tongue which is pivotally seated in the vertical slot.

Generally, the second leaf has a horizontally extending slot, and the pinion gear is rotatably seated within the horizontally extending slot with the upper surface of the pinion gear abutting the surface of the second leaf bounding the upper portion of the slot so as to bear thereon to lift the leaf.

Preferably, the adjustable mounting assembly includes a cover member disposed over the bracket, vertically extending shaft and pinion gear. The cover member is releasably secured to the bracket by connecting means, and the second leaf extends between the bracket and cover member.

Conveniently, the cover member includes the horizontally extending flange with the vertically extending slot therein, and the threaded surface portion of the rotatable means provides a worm gear to rotate the pinion gear. Alternatively, the end of the second leaf opposite the one end has a vertically extending barrel, and the barrel is pivotally mounted and axially movable upon the threaded shaft.

Generally, the barrel of the second leaf is provided by a pair of outwardly projecting knuckles, and the second leaf has a horizontally extending slot between the knuckles. The pinion gear is rotatably seated in the horizontal slot, and the upper surface of the pinion gear abuts the surface of the second leaf bounding the upper portion of the slot so as to bear thereon and lift the leaf.

DETAILED DESCRIPTION OF THE ILLUSTRATED EMBODIMENT

Figure 1:
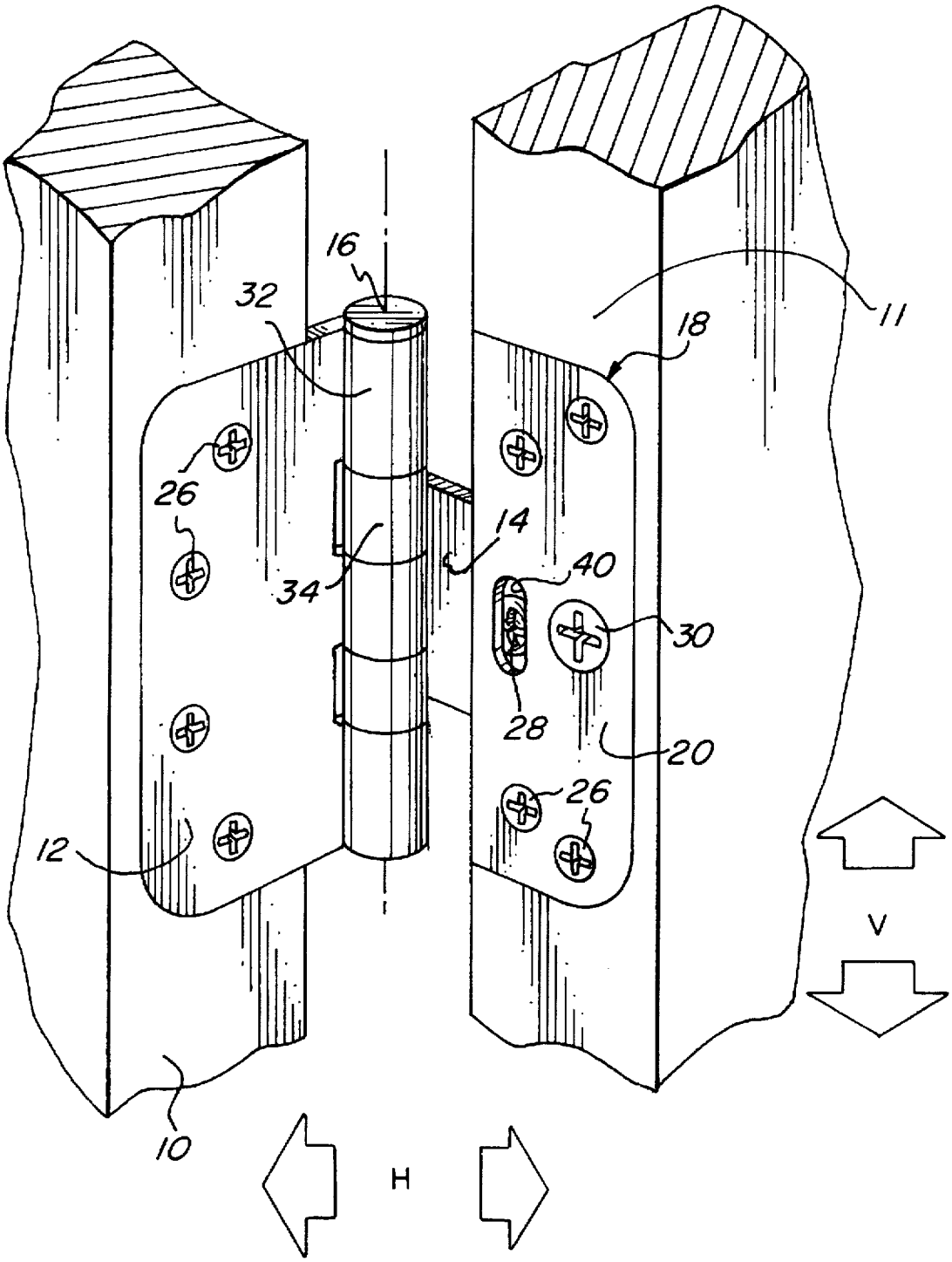
FIG. 1 is a perspective view of a door and a frame incorporating an adjustable hinge embodying the present invention.

Turning first to FIG. 1, therein illustrated is an adjustable hinge having a frame leaf 12 mounted upon a door frame 10 and a door leaf 14. The door leaf 14 is pivotably mounted within a mounting assembly generally designated by the numeral 18 which is in turn mounted upon the door 11. Both the door leaf 12 and the mounting assembly 18 are secured to the frame 10 and door 11 respectively by mounting screws 26. The frame leaf 12 includes a barrel provided by the spaced knuckles 32 which mate with knuckles 34 on the door leaf 14 and are engaged together with a pivot pin 16 which enables the leaves 12, 14 to pivot with respect to each other. The mounting assembly 18 includes a horizontal adjusting screw 28 and a vertical adjusting screw 30 to enable the door 11 to be adjusted with respect to the frame 10 either vertically in the directions indicated by the arrows V or horizontally in the directions indicated by the arrows H in FIG. 1. Both screws 28, 30 are accessible through the face plate 20 of the mounting assembly 18 to enable the facile adjustment of the hinge even after it is assembled on the frame 10 and door 11.

Figure 2:
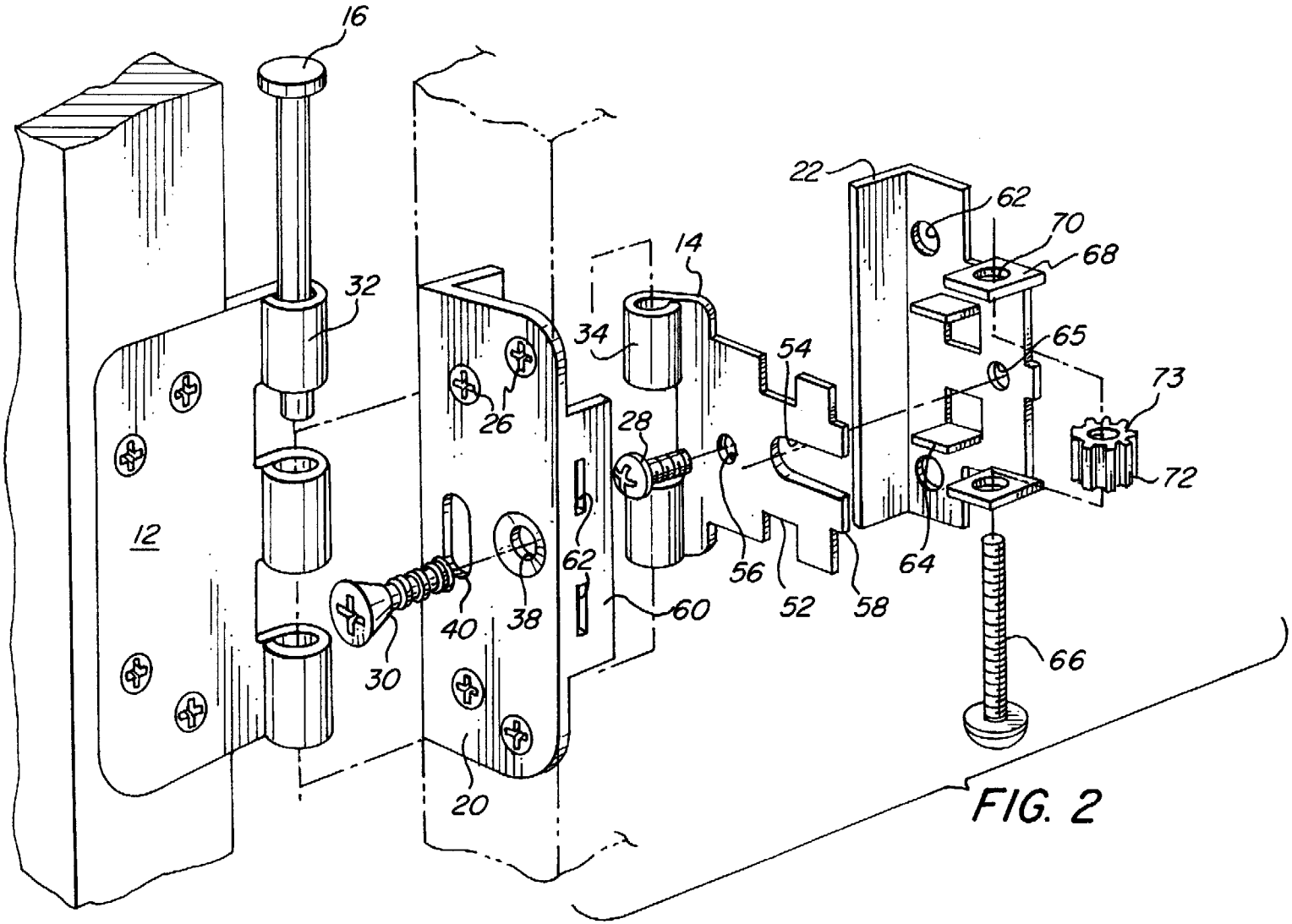
FIG. 2 is an exploded view of the adjustable hinge shown in FIG. 1.

As illustrated in FIG. 2, the mounting assembly 18 includes a bracket 22 over which the face plate 20 is mounted. The door leaf 14 extends between the bracket 22 and the face plate 20. Except for the knuckles 34, the door leaf 14 is relatively planar and includes two vertically oriented notches 52 intermediate its ends which seat within tabs 64 extending horizontally from the body of the bracket 22. Two tongues 58 extend horizontally from the end of the door leaf 14 and pivotably seat within a pair of vertically extending slots 62 in the flange 60 which extends horizontally inwardly from the body of the face plate 20.

The shank of the horizontal adjusting screw 28 is threadably engaged within a threaded aperture 56 in the center of the door leaf 14 so that the end of the shank abuts the body of the bracket 22. Although the head of the horizontal adjusting screw 28 is mounted behind the face plate 20, it can be accessed through the vertical slot 40 in the face plate 20.

The shank of the vertical adjusting screw 30 extends inwardly through a countersunk aperture 38 in the face plate 20, and through a slot 54 which extends horizontally between the tongues 58 in the door leaf 14. The end of the shank of the vertical adjusting screw 30 is rotatably seated within a countersunk aperture 65 in the bracket 22.

The inner end of bracket 22 opposite the knuckles 34 of the door leaf 14 includes a second pair of horizontally extending tabs 68 aligned apertures 70 centrally thereof. The threaded shank or shaft 66 passes through the apertures 70 and is fixed therein by either a set screw (not shown) or by providing a head on both its ends. The threaded shaft 66 also passes through an internally threaded pinion gear 72 which is rotatably and threadably seated thereon and which has gear teeth extending vertically along its outer surface. The gear teeth of the pinion 72 are engaged with the shank of the vertical adjusting screw 30, which is in the form of a worm gear to operably connect the pinion gear 72 and screw 30 to effect the rotation of the pinion gear 72.

Figure 3:
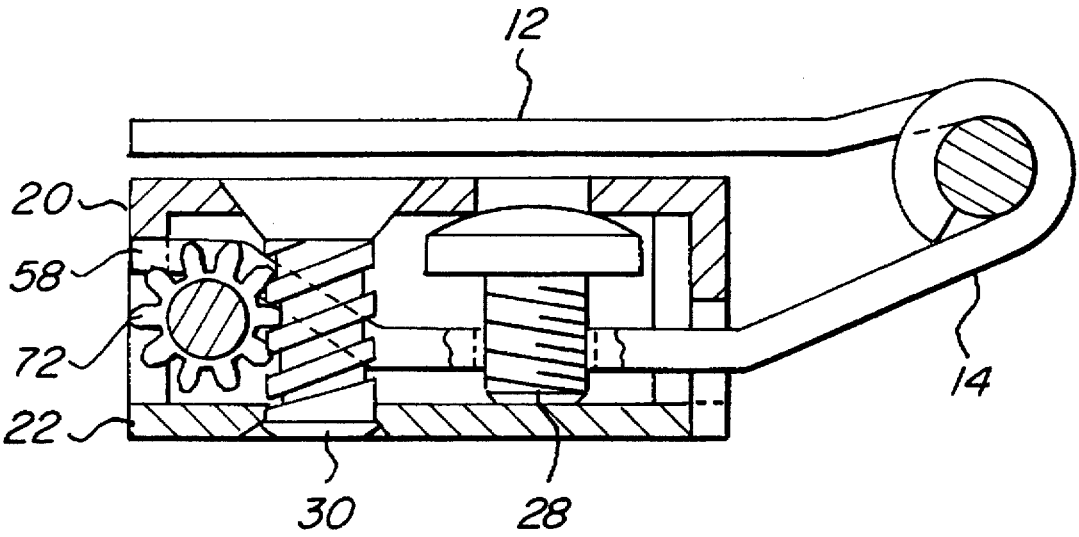
FIG. 3 is a top view of the hinge of FIG. 1.
Figure 4:
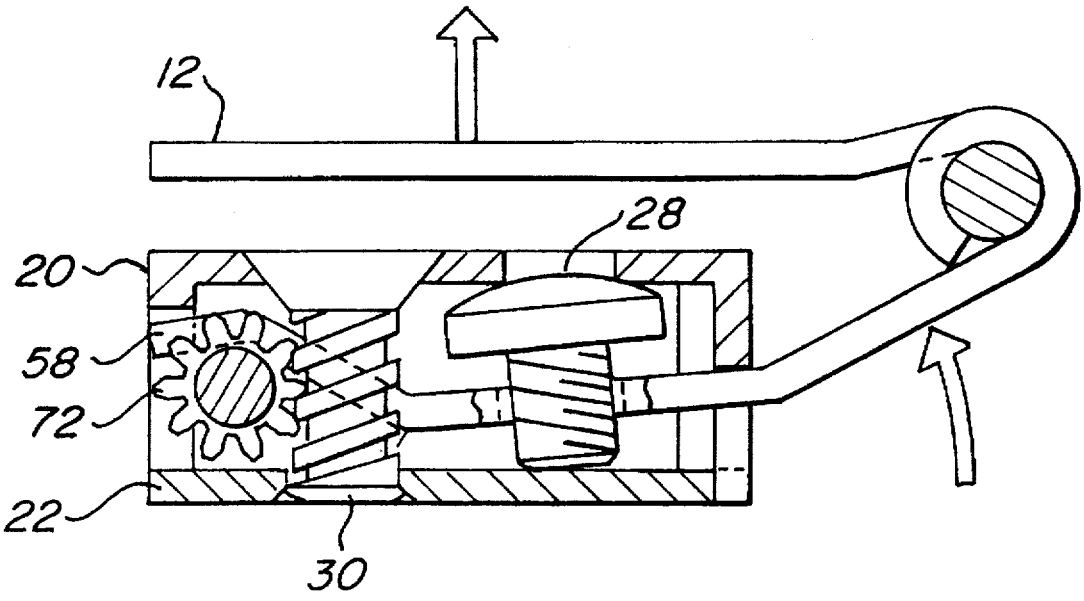
FIG. 4 is a view similar of FIG. 3 with the door leaf pivoted and arrows showing the movement of the leaves.

The horizontal adjustment operation of a hinge is illustrated in FIGS. 3 and 4. In FIG. 3, the hinge is shown in a position intermediate its range of horizontal adjustability. The horizontal adjusting screw 28 is perpendicular to the plane of the body of the bracket 22, and the door leaf 14 is intermediate the spacing created between the cover 20 and the bracket 22 adjacent the leaf knuckles 34. The hinge is adjusted horizontally by rotating the horizontal adjustment screw 28 to cause the door leaf 14 to pivot either inwardly or outwardly relative to the bracket 22.

As shown in FIG. 4, the shank of the screw 28 may be rotated through the door leaf 14 to increase the spacing between the door leaf 14 and the bracket 22 thereby pivoting the door leaf 14 outwardly with respect to the bracket 22 as indicated by the curved arrow in FIG. 4. This in turn increases the spacing between the hinge leaf 12 and the face plate 20 of the mounting assembly 18.

In order to move the door leaf 14 vertically with respect to the mounting assembly 18, the vertical adjusting screw is rotated and in turn rotates the pinion gear 72 by the worm gear surface. This causes the pinion gear 72 to move vertically and axially along the threaded shaft 66. The upper surface 73 of the pinion gear 72 abuts the surface of the door leaf 14 bounding the upper portion of the slot 54 so as to bear upon it and lifts it; if it is moved outwardly the door leaf 14 is lowered. Using a worm gear provides superior leverage to enable relatively facile vertical adjustment of heavy doors. As the door leaf 14 moves vertically with respect to the mounting assembly 18, the screw 28 moves with it but the screw remains accessible through the face plate 20 along in the range of the vertical slot 40.

Figure 5:
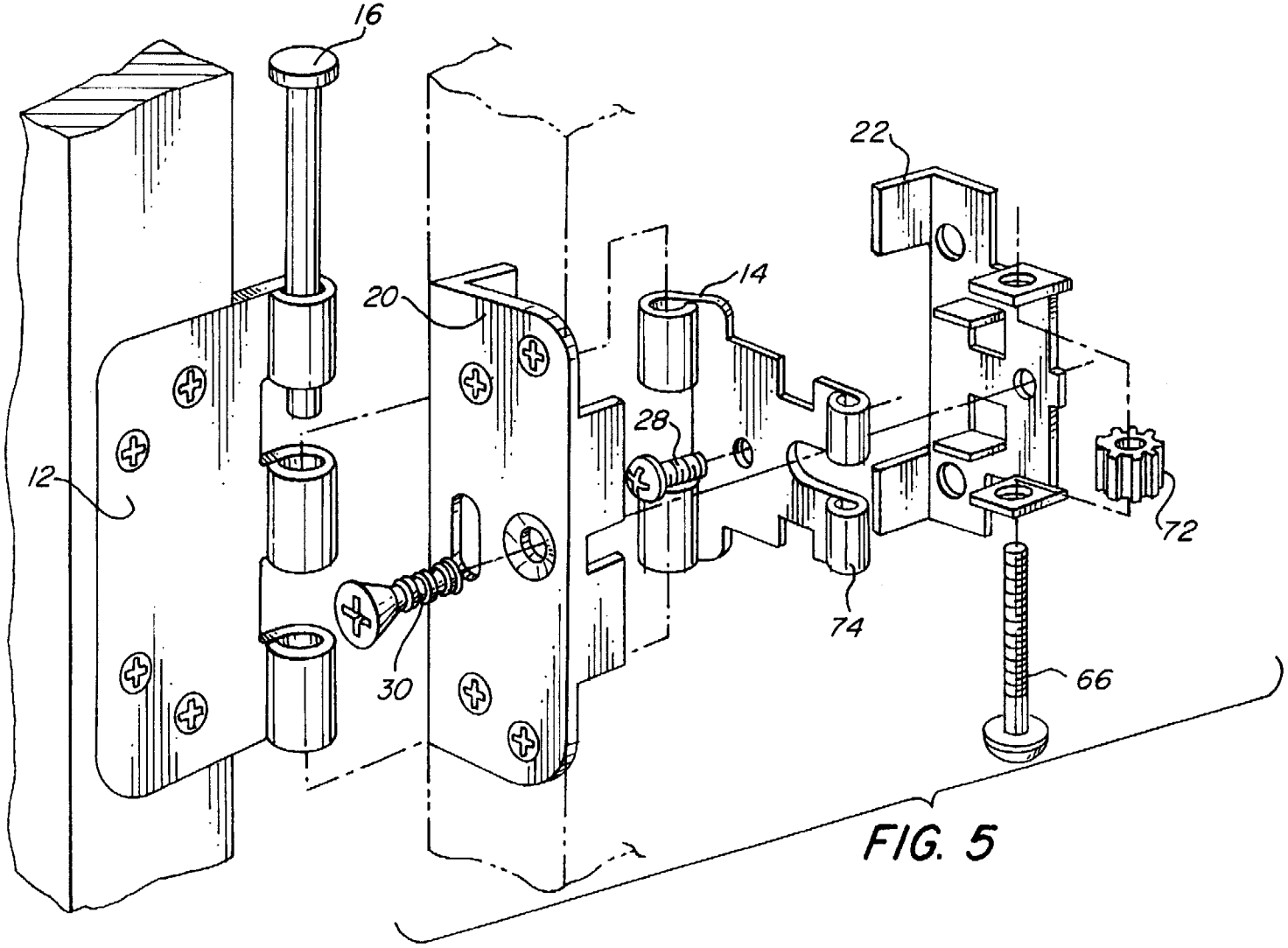
FIG. 5 is an exploded view of another embodiment of an adjustable hinge embodying the present invention having a door leaf with a barrel pivotally mounted on the mounting assembly.

As shown in FIG. 5, the tongues 58 on the door leaf 14 may be replaced by a vertically extending barrel with a pair of knuckles 74. This barrel is pivotally mounted and axially movable upon the threaded shaft 66.

As will be appreciated, various materials may be employed for the fabrication of the hinge. Most conveniently, the hinge is stamped or laser cut from wrought metal for the maximum dimensional stability and manufacturability. The metal plates may be easily bent to form the leaf knuckles and bracket tabs, and finished and plated for long life.

Thus, it can be seen from the foregoing detailed description and the accompanying drawings that the novel adjustable hinge of the present invention is one which allows both vertical and horizontal adjustment of a door with respect to a frame with a single tool and without requiring loosening or removal of the hinge from the door or the frame.

Having thus described the invention, what is claimed is:

1. An adjustable hinge for pivotally mounting a door to a frame, comprising:

(a) a first leaf adapted to be mounted on one of a frame and a door;

(b) an adjustable mounting assembly adapted to be mounted on the other of the frame and door and including (i) a bracket, (ii) a vertically extending threaded shaft rotationally and axially fixed on said bracket, (iii) a pinion gear having an internally threaded passage extending axially therethrough, in which said shaft is threadably engaged, and (iv) rotatable means having a threaded outer surface portion engaged with said pinion gear for rotating said pinion gear relative to said shaft so as to move axially said gear of said shaft;

(c) a second leaf pivotally mounted on said mounting assembly and having one end pivotally engaged with said first leaf; and (d) a horizontally extending adjusting screw having a shank threadably engaged in said second leaf intermediate the ends thereof, an end of said shank abutting said bracket, said pinion gear abutting a surface on said second leaf whereby the rotation of said pinion gear by said rotatable means moves said second leaf vertically relative to said bracket, and whereby the rotation of said adjusting screw pivots said second leaf inwardly and outwardly relative to said bracket.

2. The adjustable hinge in accordance with claim 1 wherein said first leaf is adapted to be mounted on the frame, and said mounting assembly is adapted to be mounted on the door.

3. The adjustable hinge in accordance with claim 1 wherein said threaded surface portion of said rotatable means provides a worm gear to rotate said pinion gear.

4. The adjustable hinge in accordance with claim 1 wherein said mounting assembly has a horizontally extending flange with a vertically extending slot therein, the end of said second leaf opposite said one end having an outwardly extending tongue pivotally seated in said vertical slot of said mounting assembly.

5. The adjustable hinge in accordance with claim 1 wherein said second leaf has a horizontally extending slot, wherein said pinion gear is rotatably seated within said horizontally extending slot with the upper surface of said pinion gear abutting the surface of said second leaf bounding the upper portion of said slot so as to bear thereon and vertically adjust said leaf relative to said mounting assembly.

6. The adjustable hinge in accordance with claim 1 wherein said adjustable mounting assembly includes a cover member disposed over said bracket vertically extending shaft and pinion gear, said cover member being releasably secured to said bracket by connecting means, said second leaf extending between said bracket and cover member.

7. The adjustable hinge in accordance with claim 6 wherein said cover member includes a horizontally extending flange with a vertically extending slot therein, and said threaded surface portion of said rotatable means provides a worm gear to rotate said pinion gear.

8. The adjustable hinge in accordance with claim 1 wherein the end of said second leaf opposite said one end has a vertically extending barrel, said barrel being pivotally mounted and axially moveable upon said threaded shaft.

9. The adjustable hinge in accordance with claim 8 wherein said barrel of said second leaf is provided by a pair of outwardly projecting knuckles, and said second leaf has a horizontally extending slot between said knuckles, said pinion gear being rotatably seated in said horizontal slot with the upper surface of said pinion gear abutting the surface of said second leaf bounding the upper portion of said slot so as to bear thereon and vertically adjust said leaf relative to said mounting assembly.

10. A door assembly comprising:

(a) a door;

(b) a hinge;

(c) an adjustable hinge including, (i) a first leaf mounted on said frame;

(ii) an adjustable mounting assembly mounted on said door and including (A) a bracket, (B) a vertically extending threaded shaft rotationally and axially fixed on said bracket, (C) a pinion gear having an internally threaded passage extending axially therethrough, in which said shaft is threadably engaged, and (D) rotatable means having a threaded outer surface portion engaged with said pinion gear for rotating said pinion gear relative to said shaft so as to move axially said gear of said shaft;

(iii) a second leaf pivotally mounted on said mounting assembly and having one end pivotally engaged with said first leaf; and (iv) a horizontally extending adjusting screw having a shank threadably engaged in said second leaf intermediate the ends thereof, an end of said shank abutting said bracket, said pinion gear abutting a surface on said second leaf whereby the rotation of said pinion gear by said rotatable means moves said second leaf vertically relative to said bracket, and whereby the rotation of said adjusting screw pivots said second leaf inwardly and outwardly relative to said bracket.

11. The door assembly in accordance with claim 10 wherein said mounting assembly has a horizontally extending flange with a vertically extending slot therein, the end of said second leaf opposite said one end having an outwardly extending tongue pivotally seated in said vertical slot of said mounting assembly.

12. The door assembly in accordance with claim 10 wherein said threaded surface portion of said rotatable means provides a worm gear to rotate said pinion gear, said second leaf has a horizontally extending slot, wherein said pinion gear is rotatably seated within said horizontally extending slot with the upper surface of said pinion gear abutting the surface of said second leaf bounding the upper portion of said slot so as to bear thereon and vertically adjust said leaf relative to said mounting assembly.

13. The door assembly in accordance with claim 11 wherein said adjustable mounting assembly includes a cover member disposed over said bracket vertically extending shaft and pinion gear, said cover member being releasably secured to said bracket by connecting means, said second leaf extending between said bracket and cover member, said cover member including said horizontally extending flange with said vertically extending slot therein, and said threaded surface portion of said rotatable means provides a worm gear to rotate said pinion gear.

14. The door assembly in accordance with claim 10 wherein the end of said second leaf opposite said one end has a vertically extending barrel, said barrel being pivotally mounted and axially moveable upon said threaded shaft, said barrel of said second leaf is provided by a pair of outwardly projecting knuckles, and said second leaf has a horizontally extending slot between said knuckles, said pinion gear being rotatably seated in said horizontal slot with the upper surface of said pinion gear abutting the surface of said second leaf bounding the upper portion of said slot so as to bear thereon and vertically adjust said leaf relative to said mounting assembly.

* * * * *